United States Patent [19]

Sulkowski

[11] Patent Number: 4,514,990

[45] Date of Patent: May 7, 1985

[54] HEAT EXCHANGE SYSTEM WITH SPACE HEATING, SPACE COOLING AND HOT WATER GENERATING CYCLES

[76] Inventor: Alfred Sulkowski, 4 Oak Dr., Marlboro, Conn. 06447

[21] Appl. No.: 440,370

[22] Filed: Nov. 9, 1982

[51] Int. Cl.[3] ..... F25B 27/02

[52] U.S. Cl. ..... 62/238.7; 62/324.1; 165/48 R

[58] Field of Search ..... 62/238.6, 238.7, 324.1, 62/324.2; 165/48

[56] References Cited

U.S. PATENT DOCUMENTS

| | | | |
|---|---|---|---|
| 3,529,659 | 9/1970 | Trask | 62/160 |
| 4,235,369 | 11/1980 | Huber | 62/238.6 X |
| 4,299,098 | 11/1981 | Derosier | 62/238.6 |
| 4,327,561 | 4/1982 | McNeal et al. | 62/238.6 X |
| 4,399,664 | 8/1983 | Derosier | 62/238.6 X |

FOREIGN PATENT DOCUMENTS

| | | | |
|---|---|---|---|
| 2312735 | 12/1976 | France | 62/238.6 |
| 2431663 | 3/1980 | France | 62/238.7 |
| 53-67253 | 6/1978 | Japan | 62/238.6 |
| 566527 | 9/1975 | Switzerland | 62/238.6 |

OTHER PUBLICATIONS

A. A. Field, "Solar Energy: Part II, The Continent", *Heating/Piping/Air Conditioning*, vol. 48, No. 3, p. 87, (Mar. 1976).

*Primary Examiner*—William R. Cline
*Assistant Examiner*—John J. McGlew, Jr.
*Attorney, Agent, or Firm*—Kane, Dalsimer, Kane, Sullivan and Kurucz

[57] ABSTRACT

This invention pertains to a heat exchange system having a space heating, a space cooling and an independent water heating cycle. During the space heating and space cooling cycles a refrigerant is used to transfer heat by circulating between a condenser/evaporator and a heat exchanger, the refrigerant being evaporated and condensed in the process. During the independent water heating cycle a third heat exchanger is used to condense the refrigerant. The heat removed by this exchanger is used for the evaporating of the refrigerant. A fourth heat exchanger is provided for water heating. Either water pumped from an outside source or outside air may be used as a heat source and sink.

12 Claims, 6 Drawing Figures

HEAT EXCHANGE SYSTEM WITH SPACE HEATING, SPACE COOLING AND HOT WATER GENERATING CYCLES

FIELD OF INVENTION

This invention relates to a heat exchange system and more particularly to a system having both heating and cooling cycles, and at the same time generating hot water for domestic or other uses.

BACKGROUND OF THE INVENTION

Due to the scarcity of energy such as gas, oil, and electricity many heating and cooling systems have been developed which make better use of our resources. Some of them employ a heat exchanger to generate hot water. Other systems have been developed which make better use of our resources to heat hot water. However all of these systems require complicated and costly interconnections and relatively large space. Furthermore the existing systems do not make special provisions for intermediate periods when no space heating or cooling is needed, only hot water. Heat pump water heaters are only available as independent systems with a small compressor.

SUMMARY OF THE INVENTION

Therefore a primary objective of the present invention is to provide a system which provides space heating and cooling and at the same time provides an efficient intermediate cycle for the heating of domestic water.

Another objective is to provide a single, compact, space saving system which can be installed in a residential, commercial or industrial setting with relatively few external interconnections.

A further objective is to provide a modular system which can be easily disassembled so that its components may be individually serviced or replaced.

Other advantages and objectives of the invention shall become apparent in the description of the preferred embodiment.

These objectives are obtained according to the present invention by a heat exchange system having a compressor which pumps a refrigerant through pipes to a heat transfer means and three heat exchangers. During the space heating cycle heat is transferred from a medium adapted to absorb and emit heat in said first heat exchanger to said heat transfer means by said refrigerant. During the space cooling cycle heat is transferred from said heat transfer means to the medium, and to a hot water tank by the refrigerant via the second exchanger. During the water heating cycle heat is transferred from said medium to said hot water tank. Since the last transfer requires that the refrigerant to undergo cyclically vaporization as well as condensation, the third heat exchanger is provided for the condensation wherein the medium is preheated prior to its injection into the first heat exchanger. The three heat exchangers are disposed around the water tank to provide a compact, space-saving unit. The tank and the heat exchangers form a unitary assembly which can be disassembled.

The medium may be outside air or an outside water source. The source of water as referred to hereinafter can be:

1. A large body of water such as a river or lake.
2. Two wells, one for suction, and the other for injection, with proper distance between the two wells.

3. A pipe line with recirculating water, properly sized in length and depth for proper underground heat transfer.

DESCRIPTION OF THE PREFERRED EMBODIMENT

Figure 1:
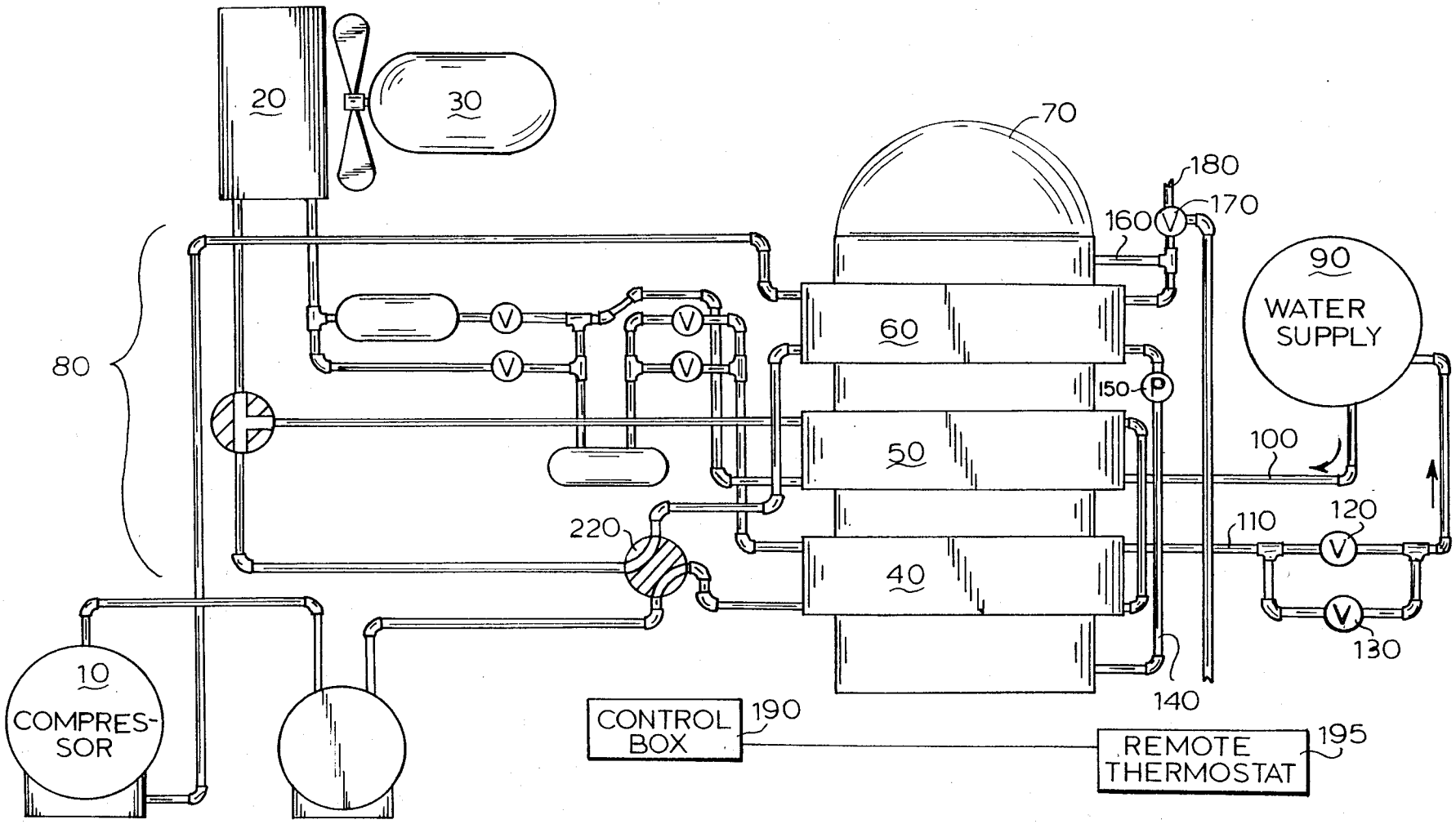
FIG. 1 shows the components of the invention and their physical interconnections for a water storage exchange.

The present invention comprises (see FIG. 1) a compressor 10, a condenser/evaporator 20 through which a fan 30 blows air, first, second and third exchanger indicated respectively by numerals 40, 50 and 60, and a water tank 70. There are also various pipes and valves interconnecting these components generally indicated by numeral 80 which are provided for circulating a refrigerant and which shall be described in full details below.

Water to the system is provided from an external water source, 90 which can be used as a heat source or heat sink. The water is provided to the system via pipe 100, and after its latent heat has been absorbed by the system, the water is ejected via pipe 110. An electrically operated valve 120 is supplied in pipe 110, for the heating cycle and a temperature-operated flow regulator valve 130 is supplied in pipe 110 for the cooling cycle. These valves are opened when a circulation of water from the water source is required.

From the bottom of tank 70 a pipe 140 carries water to a small water pump 150 which pumps the water into third heat exchanger 60, and back into the tank via pipe 160. Pipe 160 is also connected to a pressure relief valve 170, and hot water supply pipe 180. These pipes 140, 160 in cooperation with pump 150 circulate the water from tank 70 through heat exchanger 60.

Advantageously, the three heat exchangers and the tank form a single unit and all the piping is disposed around the unit thus saving space and also minimizing the complexity of the interconnections between the components. However the heat exchangers may be easily slipped off from the tank for servicing or replacement of either, for example in order to eliminate leakage.

The operation of the system is controlled by an electronic control circuit 190 in conjunction with a thermostat and other monitors 195 which read air temperature, water temperatures, etc. The control circuit is adapted to operate the valves and pumps of the system in accordance with the readings of the remote monitors and certain preset parameters (i.e. heating temperature ranges, cooling temperature ranges, temperature of the water in the tank, etc) in accordance with cycles described below and may comprise a controller such as the one disclosed in the co-pending application entitled Electronic Controller with Memory, Ser. No. 409,595, filed on Aug. 19, 1982.

Figure 2:
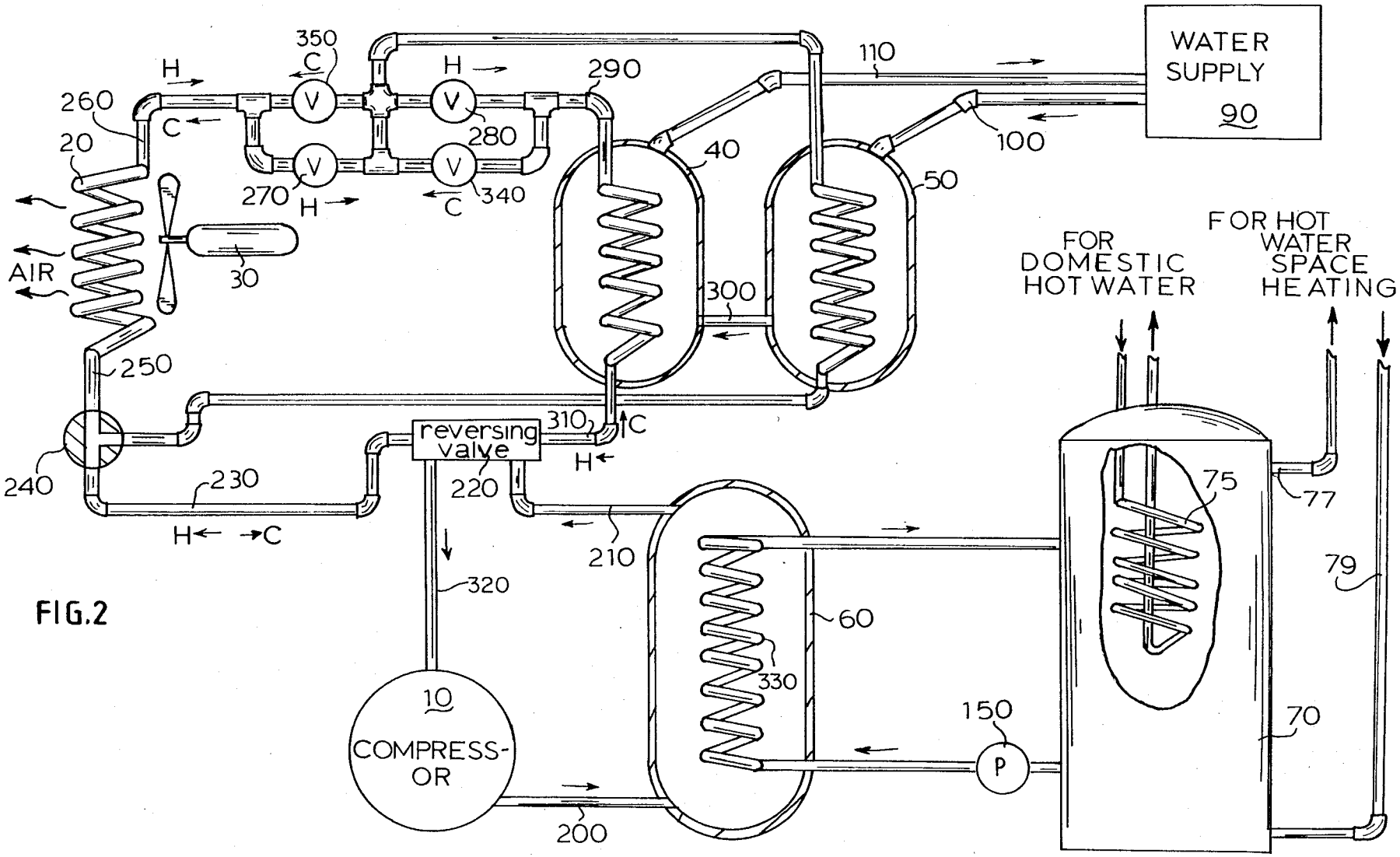
FIG. 2 shows the flow of the refrigerant during the heating and cooling cycles for the system of FIG. 1.
Figure 3:
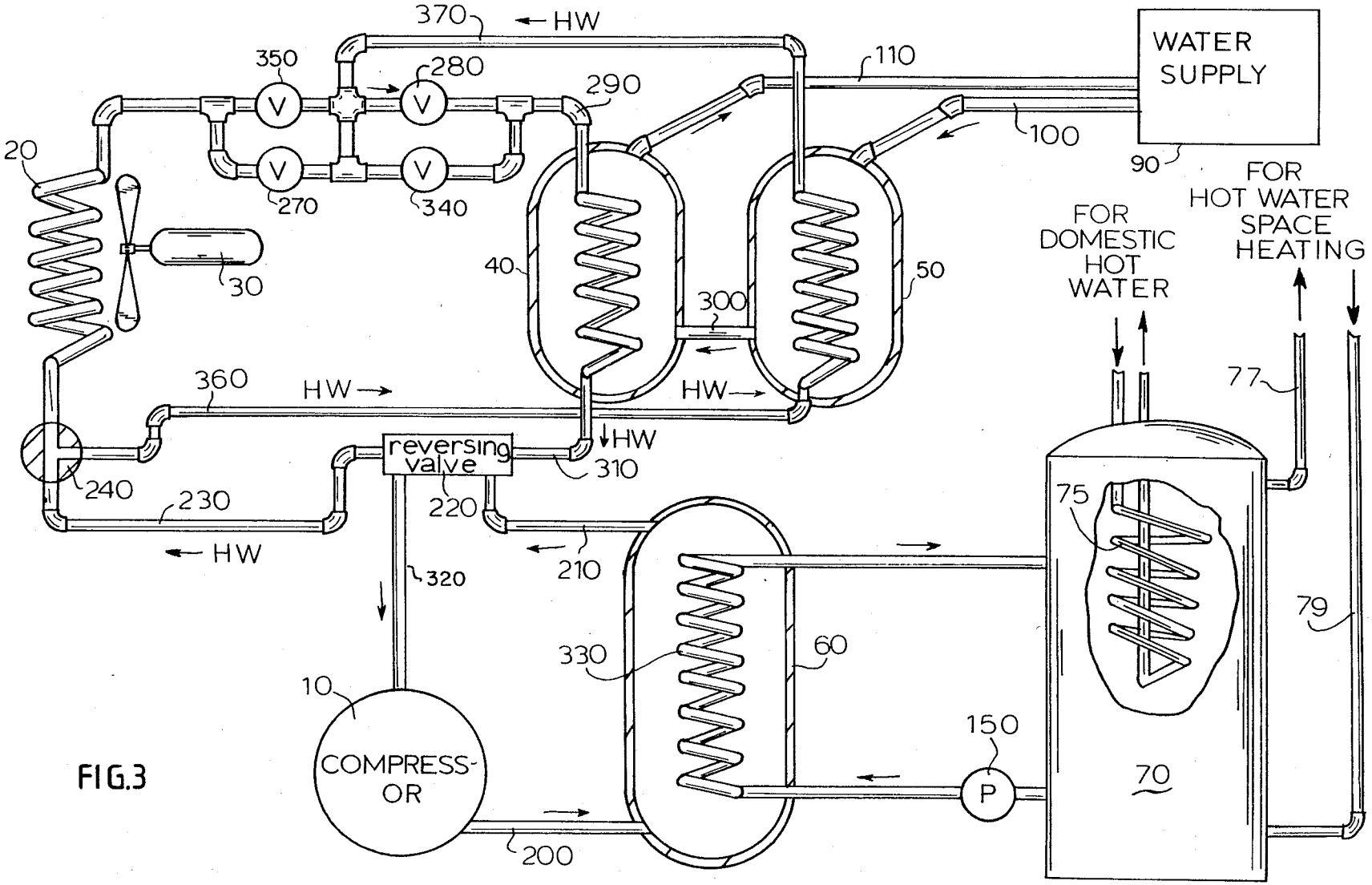
FIG. 3 shows the flow of the refrigerant during the intermediate, domestic hot-water heating cycle in a water to air heat exchange for the system of FIGS. 1 and 2.

A hydraulic equivalent of the invention is shown in FIGS. 2 and 3 wherein the flow of the refrigerant is indicated by appropriate arrows with the letters C, H, and HW indicating the space cooling, space heating, and water heating cycles. FIG. 2 applies to the space heating and cooling cycles with hot water production in the cooling cycle with FIG. 3 applies to the forced water heating cycle, in the dead band zone of the heating/cooling system, i.e. when the temperature range in which the heating requirement is satisfied but no cooling is required.

For space heating, compressor 10 pushes a hot, high-pressure, refrigerant gas such as freon through pipe 200 to heat exchanger 60. During this cycle no heat exchange takes place in 60 because pump 150 is off so that the gas flows out of the heat exchanger unchanged through pipe 210 to reversing valve 220. The water in tank 70 is heated while no space heating is required, as described below. From the reversing valve the gas flows via pipe 230 to valve 240. During the heating cycle the three-way valve 240 allows the gas to flow through pipe 250 to condenser/evaporator 20 where it condenses giving off heat. The heat warms up the air around the condenser which is then blown into the area requiring heat by fan 30. The high-pressure liquid refrigerant formed in the condenser flows out of condenser 20 via pipe 260, and check valve 270 to expansion valve 280. The expansion valve reduces the pressure of the liquid refrigerant. From expansion valve 280 the liquid flows via pipe 290 to heat exchanger 40. In this heat exchanger the refrigerant liquid evaporates by absorbing heat from water which is being pumped from water source 90, pipe 100, heat exchanger 50, pipe 300, heat exchanger 40 and back to 90 via pipe 110. During the heating cycle no heat exchange takes place in 50, because no refrigerant flows therethrough so that the water from the outside water source just flows through 50. The cold, low pressure gas formed in heat exchanger 40 flows through pipe 310 to reversing valve 220 and from there via pipe 320 back to compressor 10 thus completing the heating cycle.

Advantageously, the equipment described herein may be used either for a forced hot air heating system or for a dual system in which both hot air and hot water is used for space heating. For example, hot air may be used during fall and spring when only relatively light space heating is needed and both hot air and water is used in the winter.

For this dual system, hot water tank 70 is used for a source of hot water for standard baseboard heaters. In such a dual system an extra coil 75 may be provided within the tank for obtaining domestic hot water. Pipes 77 and 79 are then connected to the baseboards or other similar hot water space heating devices. On the other hand, if hot water is not needed for space heating then the tank may be used as a source of domestic hot water.

In summary, during the heating cycle the refrigerant absorbs heat from the water source and releases it in to the air surrounding the condenser, in a water/air heat exchange.

For space cooling, the hot, high-pressure gas from compressor 20 is still passed through heat exchanger 60 via pipes 200 and 210, however this time the pump 150 is activated and therefore some heat is removed from the gas by the heat exchanger and passed to the hot water contained in coil 330. This exchange lowers the temperature of the refrigerant somewhat but does not change its state. The reversing valve 220 forces the refrigerant to flow out through pipe 310 to heat exchanger 40 where the gas cools off and condenses into a liquid. The heat given off by the refrigerant during condensation is absorbed by the water circulated within the heat exchanger. The cold high-pressure refrigerant liquid then flows through pipe 290, and check valve 340 to expansion valve 350. The expansion valve reduces the pressure of the liquid. The cold low-pressure liquid then flows through pipe 260 to condenser 20 in which it evaporates to form a cold, low-pressure gas by absorbing the heat from the hot air blown across the condenser by fan 30. The hot air is cooled in the process and used for air conditioning. Cold, low-pressure gas flows from condenser 20 through pipe 250, valve 240, pipe 230, reversing valve 220 and pipe 320 back to the compressor to complete the cycle.

During this cycle heat exchanger 50 is still idle.

In summary, during the cooling cycle the refrigerant removes heat from the air blown across the condenser and transfers it to the water in the tank 70 and the water circulated from water source 90 in an air/water heat exchange.

During the third cycle the system provides heat to the hot water tank 70, and is used when neither space cooling nor space heating is requested by a thermostat. During this cycle the hot, high-pressure gas is again passed through heat exchanger 60, (FIG. 3) where some of its heat is absorbed by the hot water circulated through tank 70 and coil 330 by pump 150. As previously mentioned, the heat removed in heat exchanger 60 from the refrigerant is not sufficient to change its state. Therefore a further step is provided in the cycle. From exchanger 60 the refrigerant flows via pipe 210, reversing valve 220, pipe 230, valve 240 and pipe 360 to heat exchanger 50. In this exchanger the refrigerant is condensed to a cold high-pressure liquid. The heat produced in this process is absorbed by the circulating water from water source 90. The cold high-pressure liquid refrigerant then flows via pipe 370 to expansion valve 280. Valve 280 reduces the pressure of the liquid refrigerant which then flows to heat exchanger 40 where it evaporates by absorbing heat from circulating water received from heat exchanger 50. From heat exchanger 40 the cold, low-pressure gas flows through pipe 310, reversing valve 220, and pipe 320 back to compressor 10.

It should be noted that in heat exchanger 50 the temperature of the circulating water is raised because it absorbs heat and therefore the temperature of the circulating water within heat exchanger 40 is higher than the temperature of water supplied by pipe 100. This temperature difference makes the heat exchange within exchanger 40 (where heat is absorbed by the refrigerant during its evaporation) much more efficient. Furthermore, the whole process becomes more desirable from an environmental point of view.

In summary, during the third cycle, heat is removed from the circulating water and transferred to the hot water in the tank. A portion of the heat is also used to pre-heat the circulating water, thus improving the efficiency of the cycle. During this cycle a water/water exchange takes place.

Figure 4:
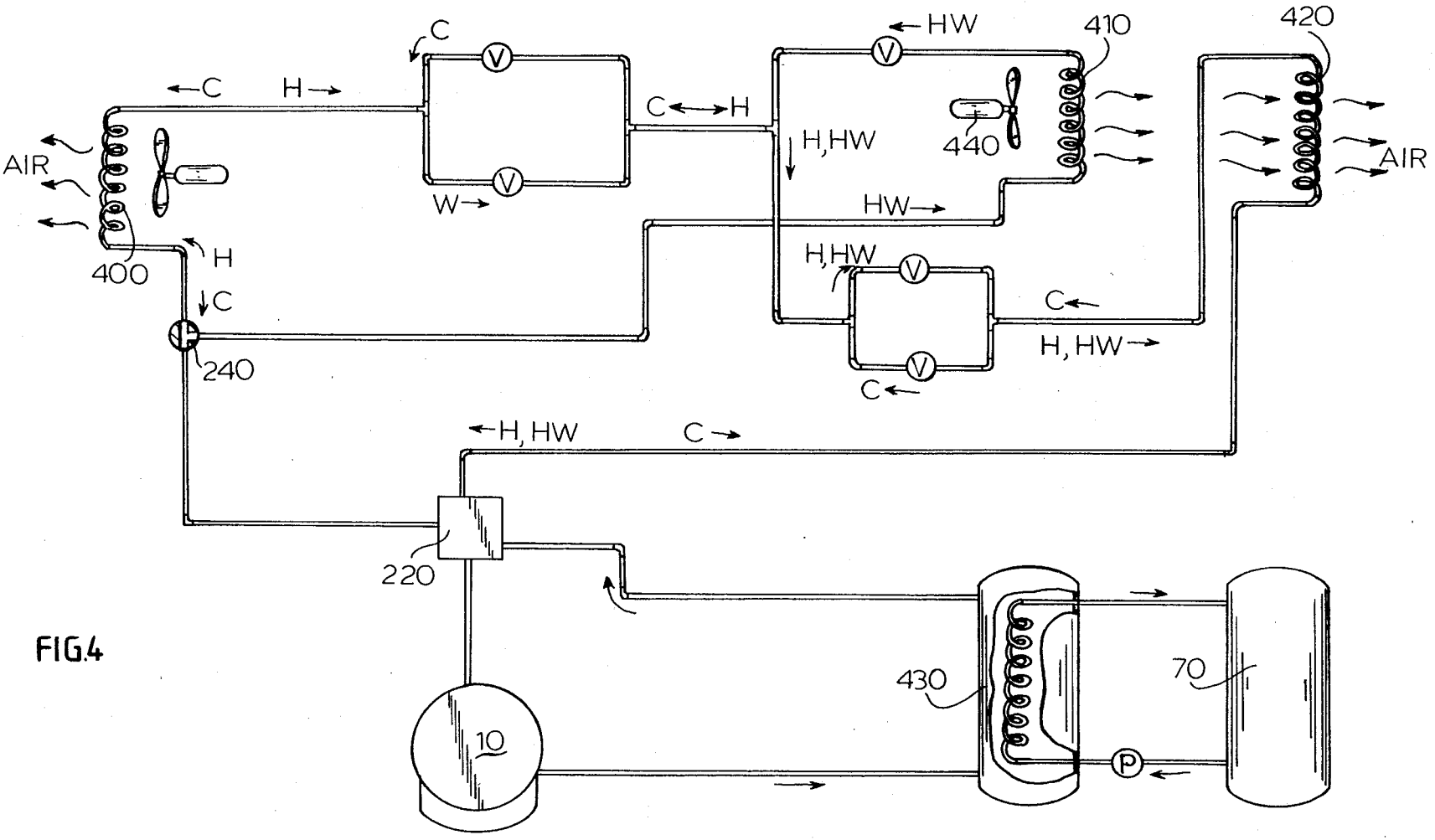
FIG. 4 shows another embodiment of the invention with an air to air heat exchange system.

A different embodiment is shown in FIG. 4. In this embodiment, instead of circulating water, outside air is used as a heat source or heat sink. The embodiment comprises three condenser/evaporators 400, 410 and 420 and a heat exchanger 430. Preferably heat exchanger 430 is disposed around water tank 435 just like the exchangers in the embodiment of FIG. 1. Condenser/evaporators 410 and 420 are disposed outdoors and fan 440 is adapted to blow air across them thus supplying the heat source or sink for the system. A careful comparison of FIG. 4 with FIGS. 2 and 3 will reveal that the two embodiments operate on identical thermodynamic principles. In particular condenser/evaporators 400, 410 and 420 and heat exchanger 430 in FIG. 4 perform the same function as condenser/evaporator 20 and heat exchangers 40, 50 and 60 in FIGS. 2 and 3, respectively. Furthermore, it should be appreciated that condenser 410, which, like heat exchanger 50, is active only during the third cycle is disposed between condenser 420 and fan 440 so that the air blown by the fan across the condensers is preheated by condenser 410 before it reaches condenser 420 just like the circulating water is preheated by heat exchanger 50 (FIG. 3) before it enters heat exchanger 40. This feature, as mentioned above, makes the invention more efficient.

Figure 5:
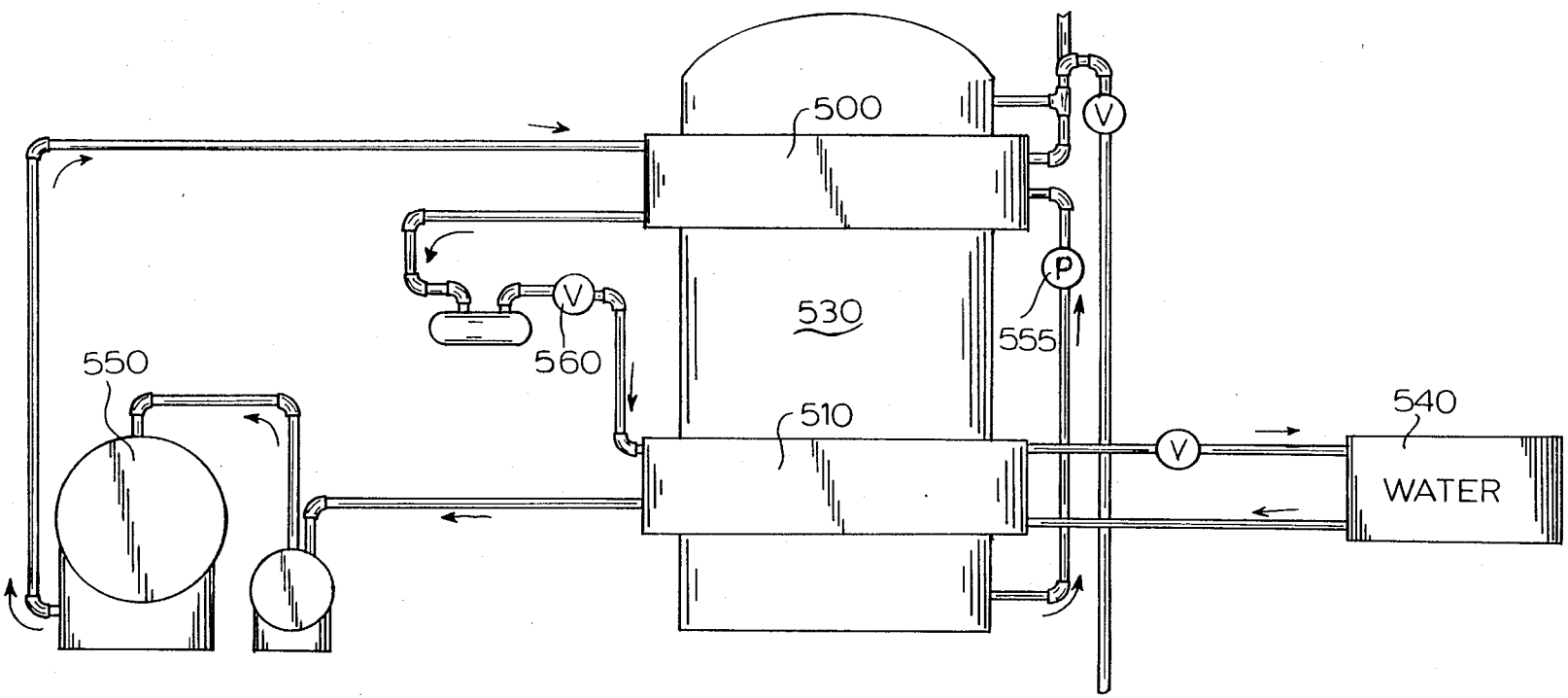
FIG. 5 shows a third embodiment system for hot water heating only—water to water—to replace, or substitute a hot water boiler.

A third embodiment is shown in FIG. 5. In this embodiment two relatively small heat exchangers 500 and 510 are disposed around hot water storage tank 530. Like in the first embodiment circulating water from source 540 is used as a source of heat, but here the heat is used only for the heating of water to be used for either baseboard heating or domestic hot water and therefore the device described herein is independent of any other heating and/or cooling system. Briefly, hot refrigerant is pumped under pressure by compressor 550 into heat exchanger 500 where it condenses into liquid refrigerant emitting heat which is absorbed by domestic hot water circulating through the heat exchanger and the tank by pump 555. From exchanger 500 the liquid is passed through expansion valve 560 which lowers its pressure to heat exchanger 510. In this heat exchanger the liquid absorbs heat from the circulating water and evaporates. The resulting low-pressure gas is then returned to compressor 550.

Figure 6:
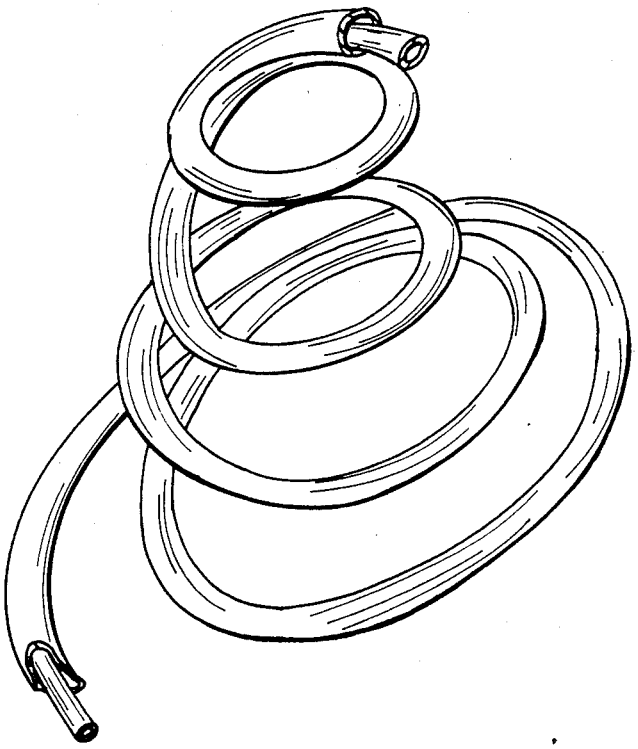
FIG. 6 shows sections of the concentric pipes used in the heat exchangers.

The heat exchangers described herein preferably comprise two concentric pipes, one pipe being disposed within the other. As shown in FIG. 6, the two pipes may be formed in a helical shape. This type of heat exchange requires little space and is very efficient. The outer pipe may be used for water and the inner pipe for freon or vice versa.

It is clear that the heat exchange system presented is highly adaptable for new installations or for upgrading existing installations.

It is obvious that other modifications may be made to the invention by one skilled in the art without departing from its scope as defined in the appended claims.

I claim:

1. A heat exchange system having a space heating cycle, a space cooling cycle with water heating, and an independent water heating cycle comprising:

a compressor;

a refrigerant adapted to absorb and emit heat by changing from a liquid to a gas and from a gas to a liquid phase respectively circulated by said compressor;

a medium adapted to absorb or emit heat;

a water storage tank;

a first transfer means for transferring heat for space heating from said refrigerant during the heating cycle and for transferring heat to said refrigerant for space cooling during the cooling cycle;

a second transfer means for transferring heat from said medium to said refrigerant during the space heating cycle and independent water heating cycle and for transferring heat to said medium from said refrigerant during said space cooling;

a third transfer means for transferring excess heat during the independent water heating cycle from said refrigerant to said medium; to condense said refrigerant;

a fourth transfer means for transferring heat from said refrigerant to a water storage tank;

a piping means operatively connected to allow the flow of said refrigerant between said compressor, and said transfer means; and a control means for controlling said flow; whereby during the heating cycle heat is transmitted by the refrigerant form said medium to said first transfer means;

whereby during the cooling cycle heat is transmitted by the refrigerant from said first transfer means to said medium; and whereby during the independent water heating cycle heat for water heating is transmitted from said medium to said tank.

2. The system of claim 1 wherein during the water heating cycle said medium is pre-heated by said third transfer means before it reaches said second transfer means.

3. The system of claim 2 wherein during the heating cycle said refrigerant is condensed under high pressure in said first transfer means and is evaporated under low pressure in said second transfer means.

4. The system of claim 3 wherein during the cooling cycle said refrigerant is condensed under high pressure in said second transfer means and is evaporated under low pressure in said first transfer means.

5. The system of claim 4 wherein during the water heating cycle said refrigerant is condensed under high pressure in said third transfer means and is evaporated under low pressure in said second transfer means.

6. The system of claim 5 wherein the refrigerant also transfers heat to said hot water storage tank during said cooling cycle.

7. The system of claim 6 wherein said fourth transfer means comprises a first heat exchanger disposed around said water storage tank and adapted to exchange heat between said refrigerant and domestic water stored in said tank.

8. The system of claim 7 wherein said first transfer means comprises a condenser adapted to exchange heat between air used for space heating or cooling and the refrigerant.

9. The system of claim 8 wherein said medium is water being circulated into the system from an outside source and wherein said second transfer means comprises a second heat exchanger and said third transfer means comprises a third heat exchanger, said second and third heat exchangers being disposed around said tank and adapted to exchange heat between said refrigerant and said circulating water.

10. The system of claim 9 wherein said heat exchangers comprise a first pipe provided for the refrigerant and a second pipe provided for the water, said first pipe being provided inside said second pipe, said pipes being formed into continuous coils.

11. The system of claim 10 wherein said medium is outside air and wherein said second transfer means comprises a second condenser, and said third transfer means comprises a third condenser, said second and third condensers being adapted to exchange heat between the outside air and the refrigerant.

12. The system of claim 1 wherein said heat exchangers comprise a first pipe provided for the refrigerant and a second pipe provided for the water, said first pipe being provided inside said second pipe, said pipes being formed into continuous coils.

* * * * *

UNITED STATES PATENT AND TRADEMARK OFFICE

CERTIFICATE OF CORRECTION

PATENT NO. : 4,514,990

DATED : May 7, 1985

INVENTOR(S) : ALFRED SULKOWSKI

It is certified that error appears in the above-identified patent and that said Letters Patent is hereby corrected as shown below:

Column 3, line 10, "with" should be --while--.

Signed and Sealed this

*Eighth* Day of *October 1985*

[SEAL]

*Attest:*

DONALD J. QUIGG

*Attesting Officer*

*Commissioner of Patents and Trademarks—Designate*